US007919932B2

(12) United States Patent
Lim et al.

(10) Patent No.: US 7,919,932 B2
(45) Date of Patent: Apr. 5, 2011

(54) APPARATUS AND METHOD FOR CONTROLLING LIGHTING BRIGHTNESS THROUGH DIGITAL CONVERSION

(75) Inventors: Joon Hyung Lim, Gunpo-si (KR); Tah Joon Park, Suwon-si (KR); Koon Shik Cho, Suwon-si (KR); Kwang Mook Lee, Suwon-si (KR); Bo Il Seo, Seoul (KR)

(73) Assignee: Samsung LED Co., Ltd., Gyunggi-do (KR)

( * ) Notice: Subject to any disclaimer, the term of this patent is extended or adjusted under 35 U.S.C. 154(b) by 350 days.

(21) Appl. No.: 12/108,778

(22) Filed: Apr. 24, 2008

(65) Prior Publication Data

US 2009/0160362 A1 Jun. 25, 2009

(30) Foreign Application Priority Data

Dec. 20, 2007 (KR) ..... 10-2007-0134204
Dec. 21, 2007 (KR) ..... 10-2007-0135426

(51) Int. Cl.
*H05B 37/02* (2006.01)

(52) U.S. Cl. ..... 315/291; 315/246; 315/307; 341/53; 341/143; 341/144

(58) Field of Classification Search ..... 315/246, 315/291, 307; 341/53, 111, 126, 143, 144; 375/238
See application file for complete search history.

(56) References Cited

U.S. PATENT DOCUMENTS

| | | | | |
|---|---|---|---|---|
| 6,337,544 | B1 * | 1/2002 | Wang et al. | 315/291 |
| 6,778,118 | B2 | 8/2004 | Heizmann et al. | |
| 7,148,632 | B2 * | 12/2006 | Berman et al. | 315/189 |
| 7,180,252 | B2 * | 2/2007 | Lys et al. | 315/312 |
| 7,397,205 | B2 * | 7/2008 | Huang et al. | 315/360 |

FOREIGN PATENT DOCUMENTS

| | | | |
|---|---|---|---|
| JP | 2002-204592 | A | 7/2002 |
| KR | 10-1989-0016739 | A | 11/1989 |
| KR | 10-2004-0021270 | A | 3/2004 |

* cited by examiner

*Primary Examiner* — Thuy Vinh Tran
(74) *Attorney, Agent, or Firm* — Lowe Hauptman Ham & Berner, LLP

(57) ABSTRACT

Provided is an apparatus for controlling lighting brightness including a light control unit that generates a control signal for controlling the brightness of a plurality of lightings; a digital signal generating unit that converts a signal corresponding to the control signal at each period so as to generate non-periodic digital signals; and a driving voltage generating unit that generate driving voltages by converting the digital signals into analog signals.

23 Claims, 12 Drawing Sheets

[FIG. 1]
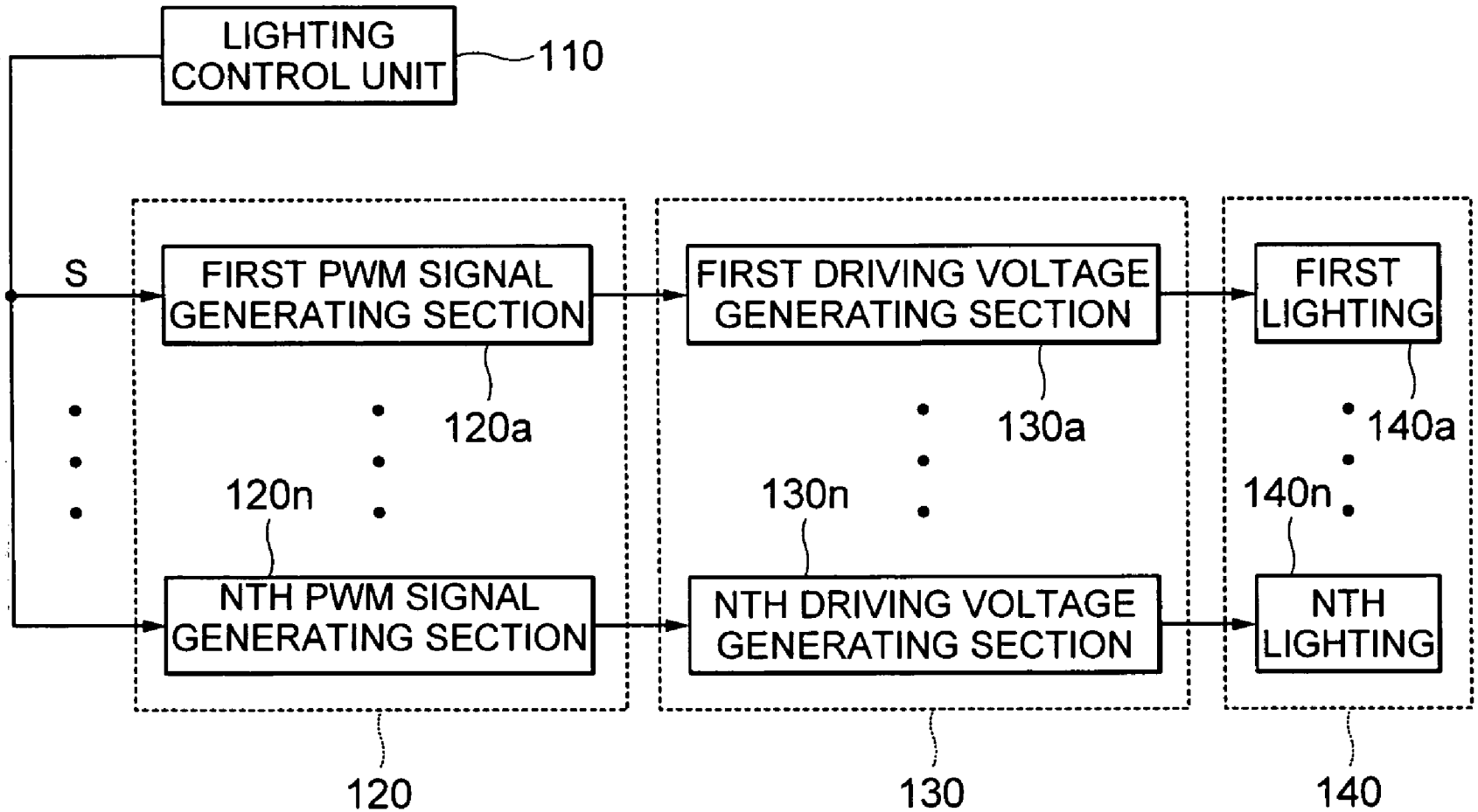
- Prior Art -

[FIG. 2]
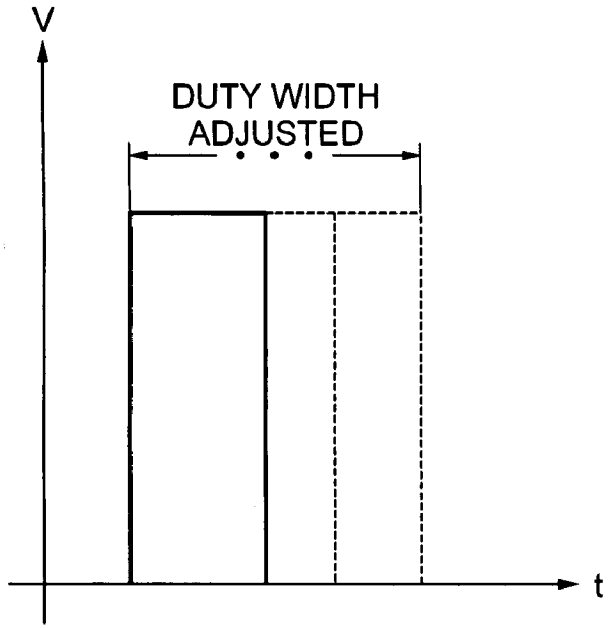
- Prior Art -
[FIG. 3]
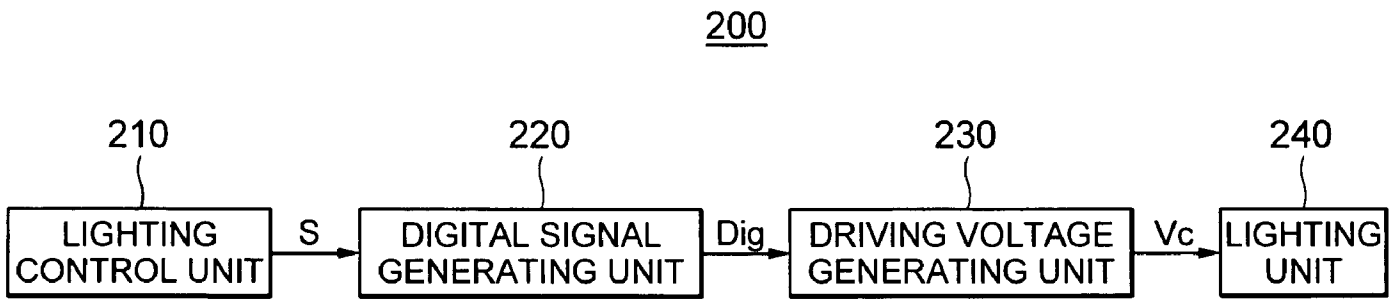

[FIG. 4]
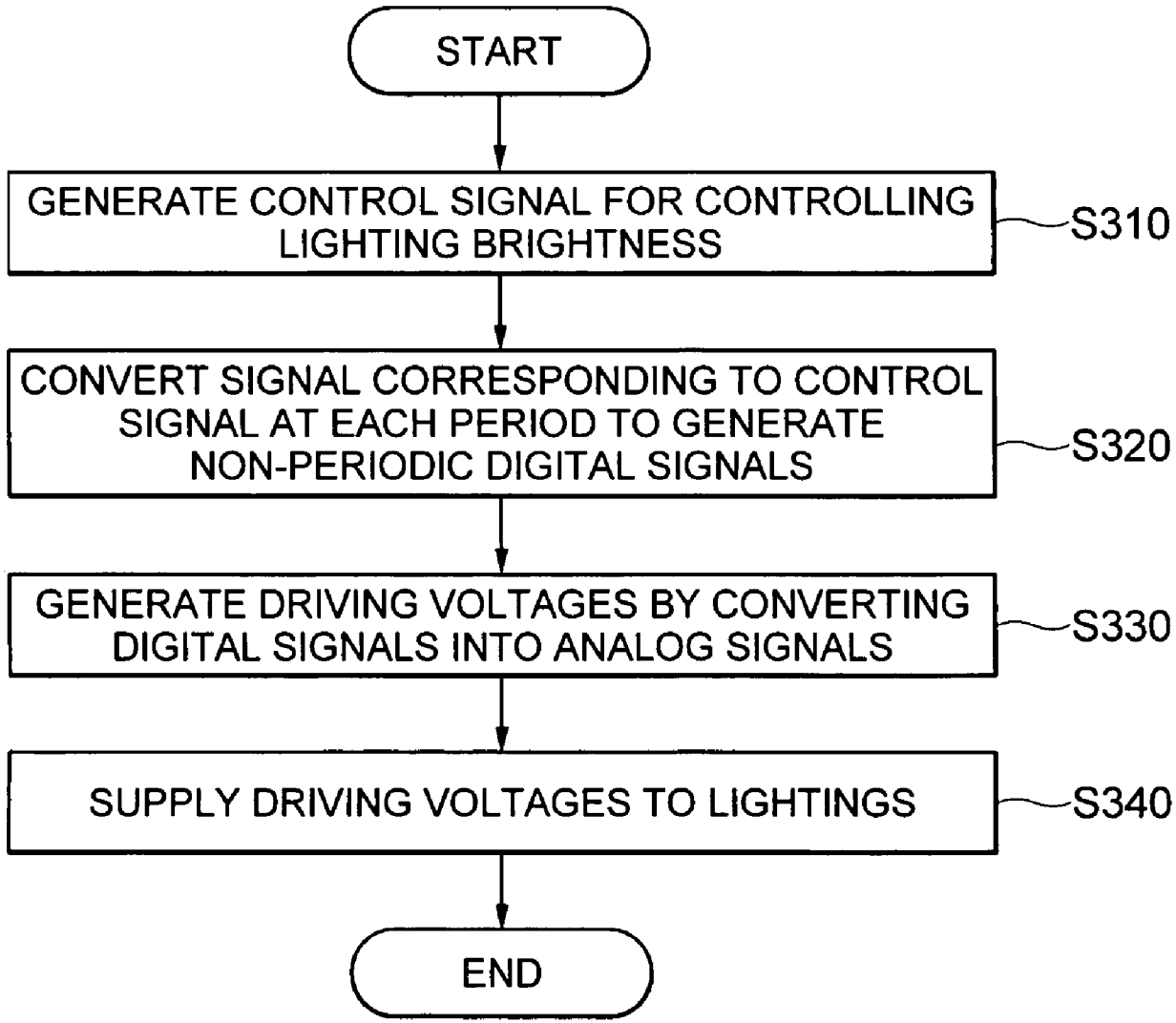

[FIG. 5]
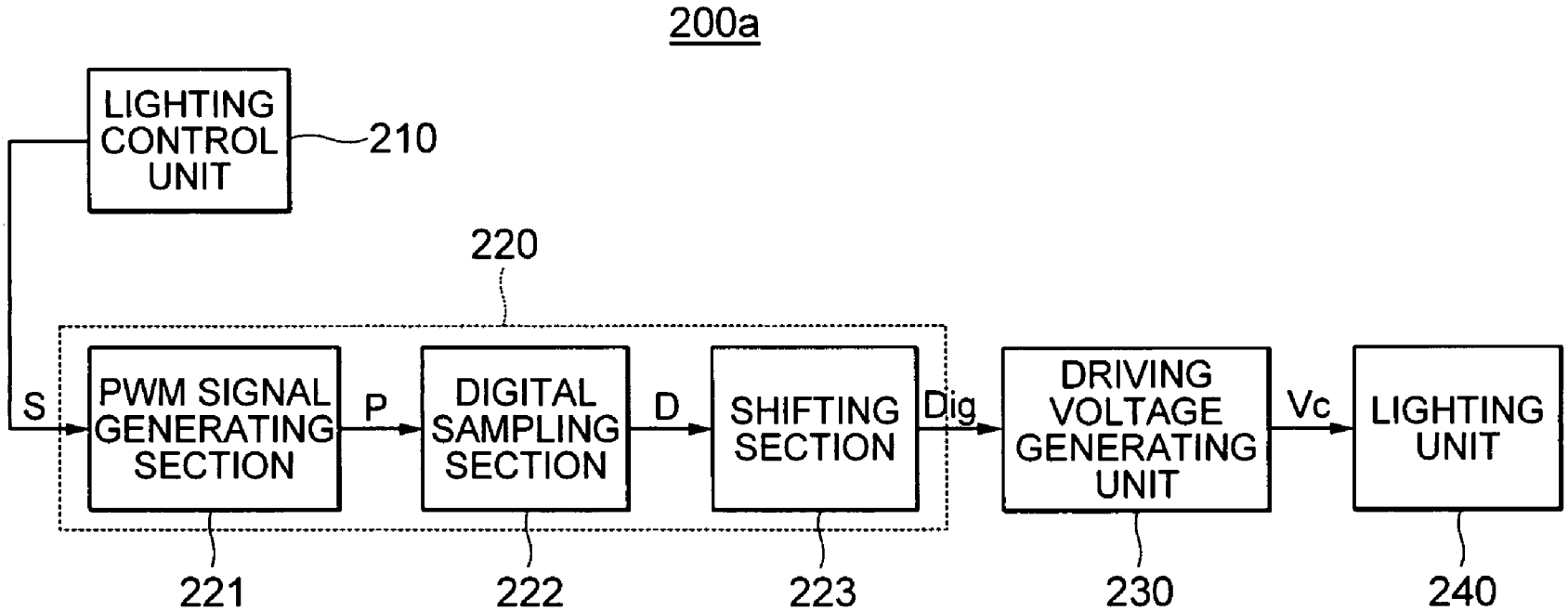

[FIG. 6]
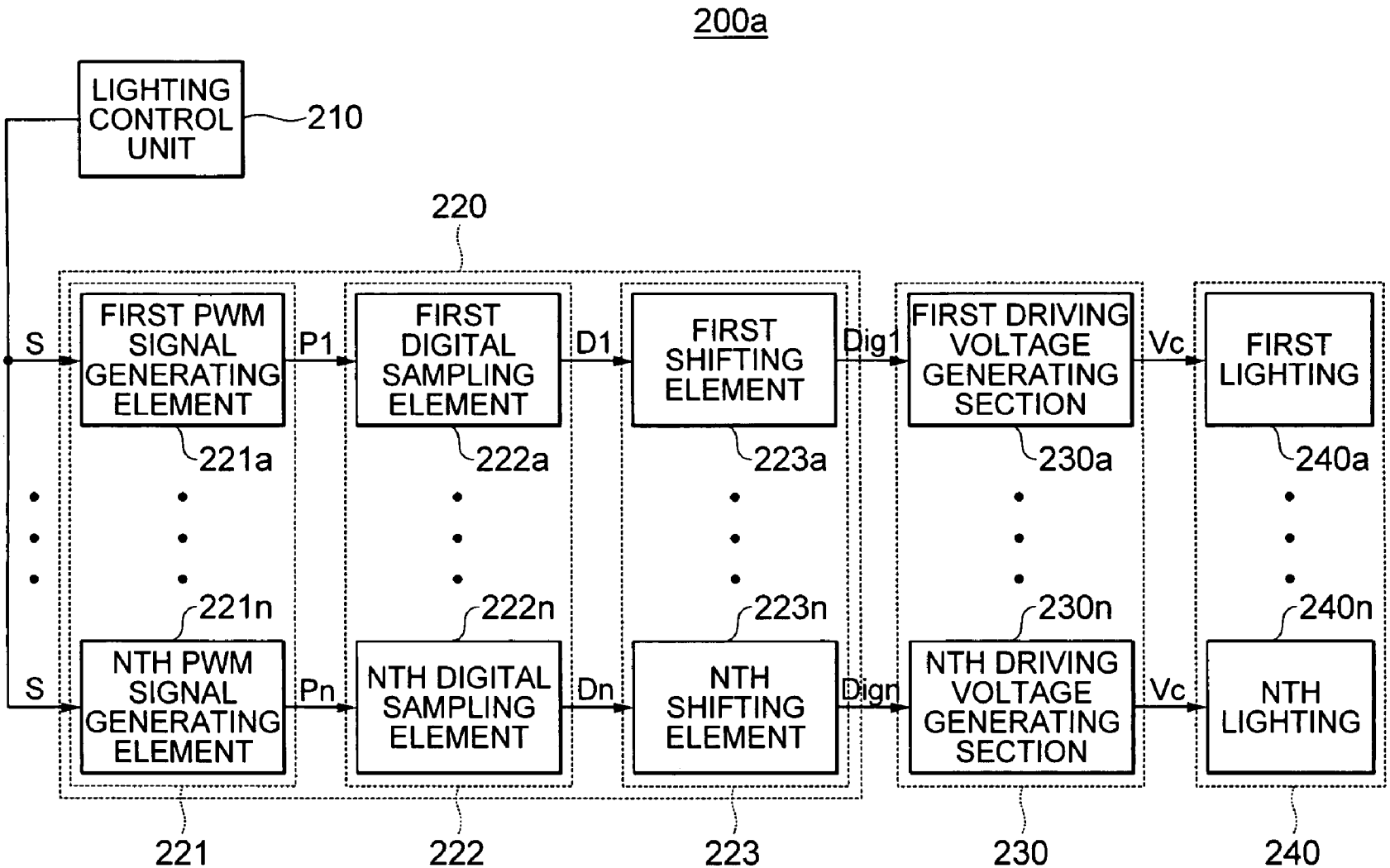

[FIG. 7]
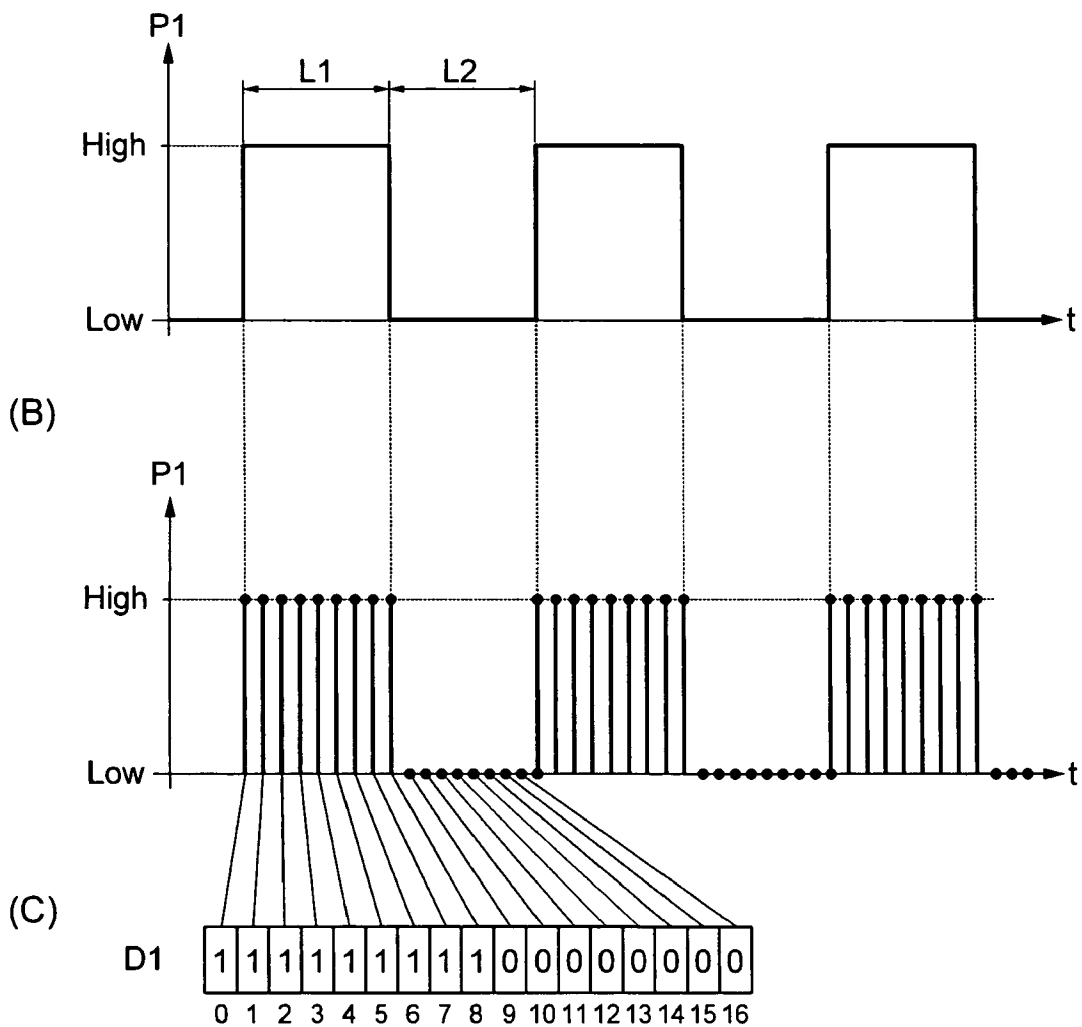

[FIG. 8]
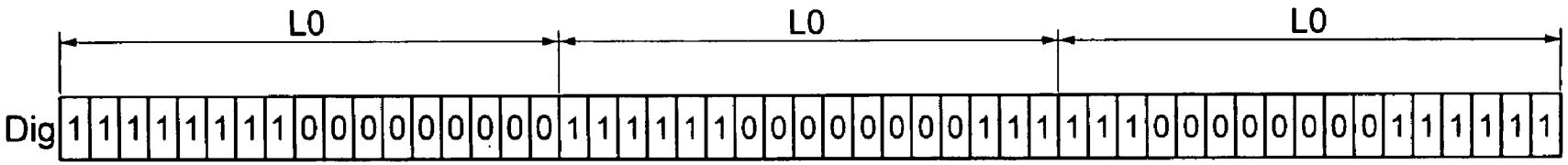
[FIG. 9]
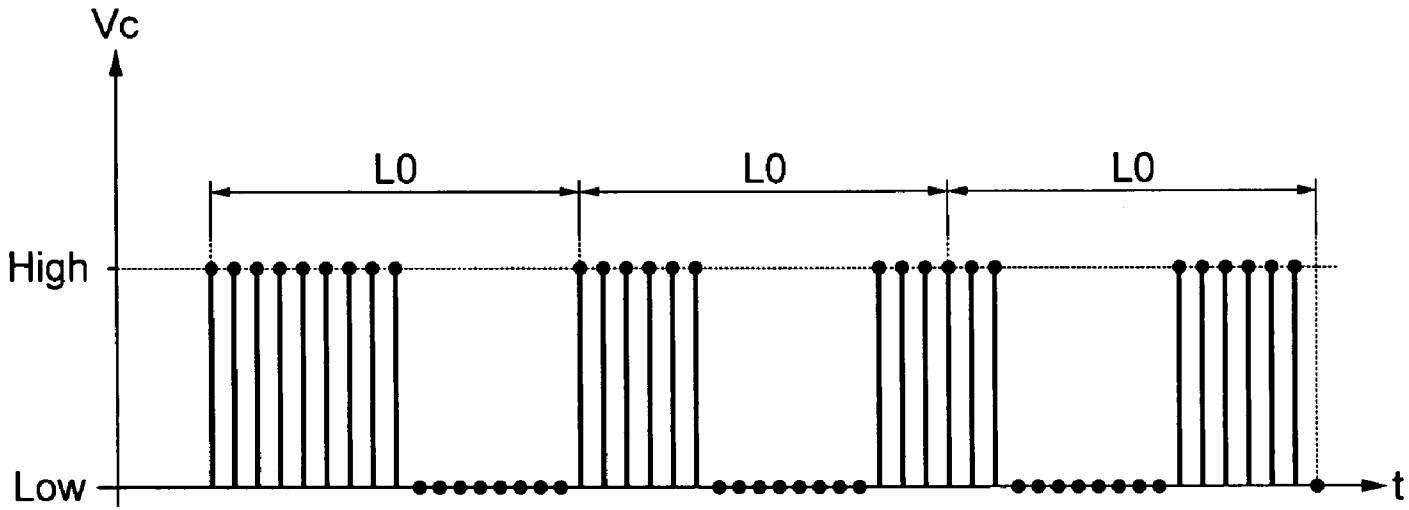

[FIG. 10]
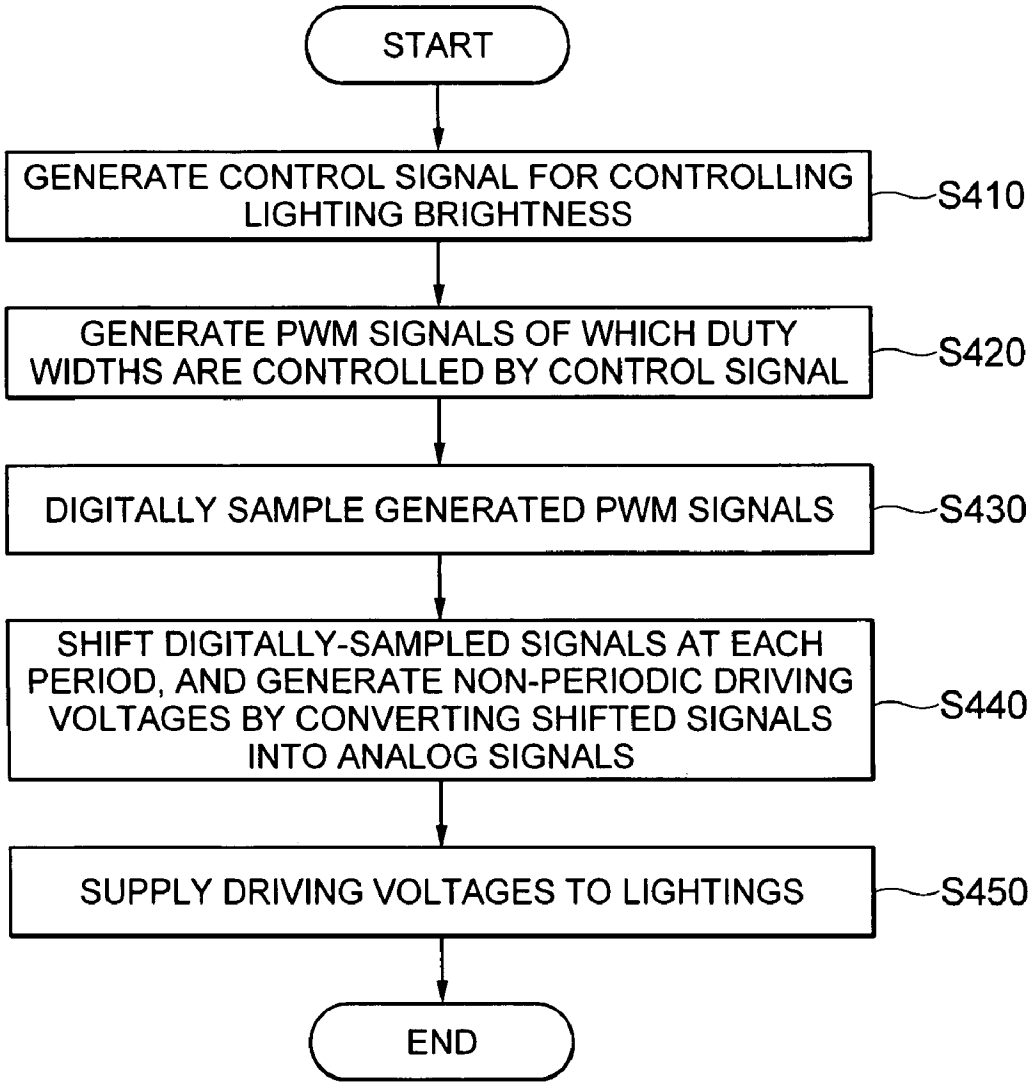

[FIG. 11]
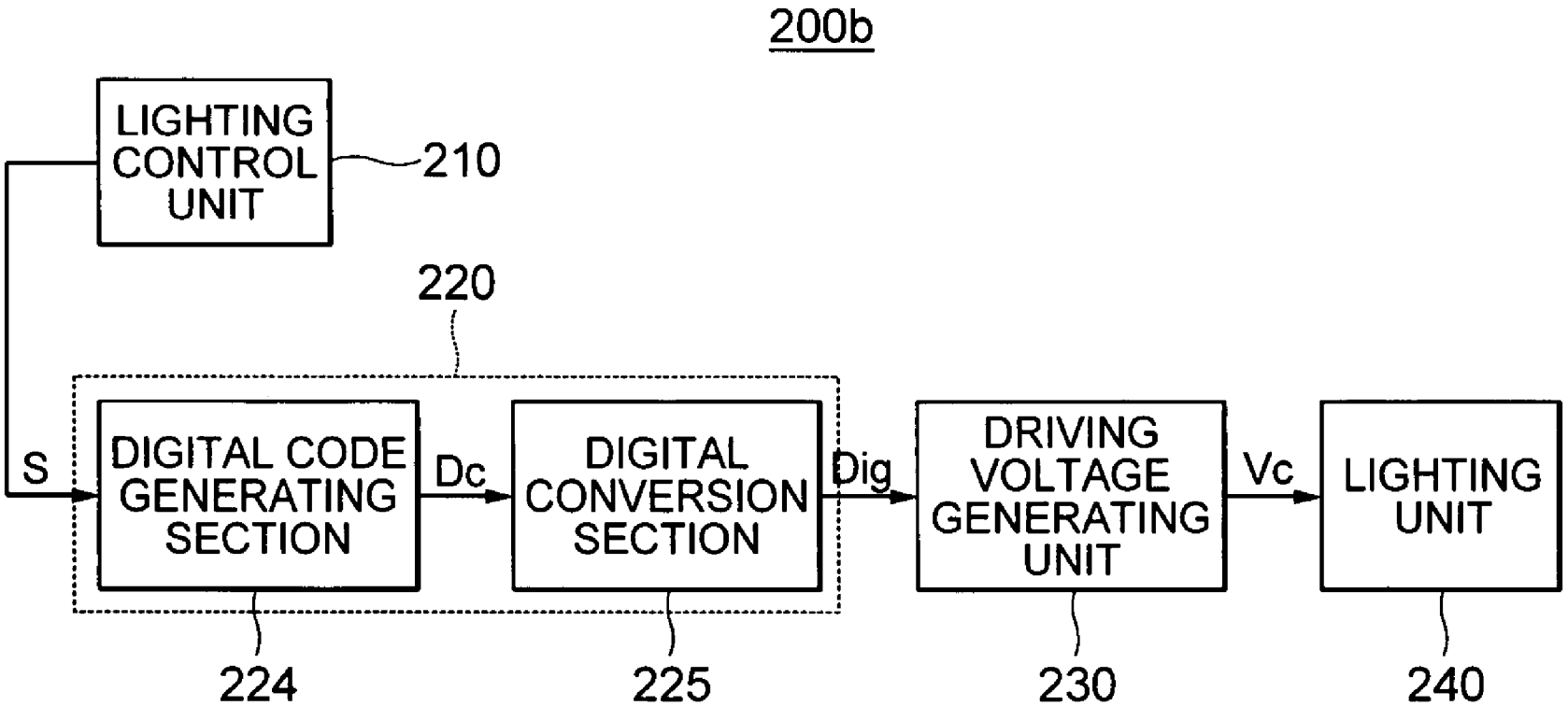

[FIG. 12]
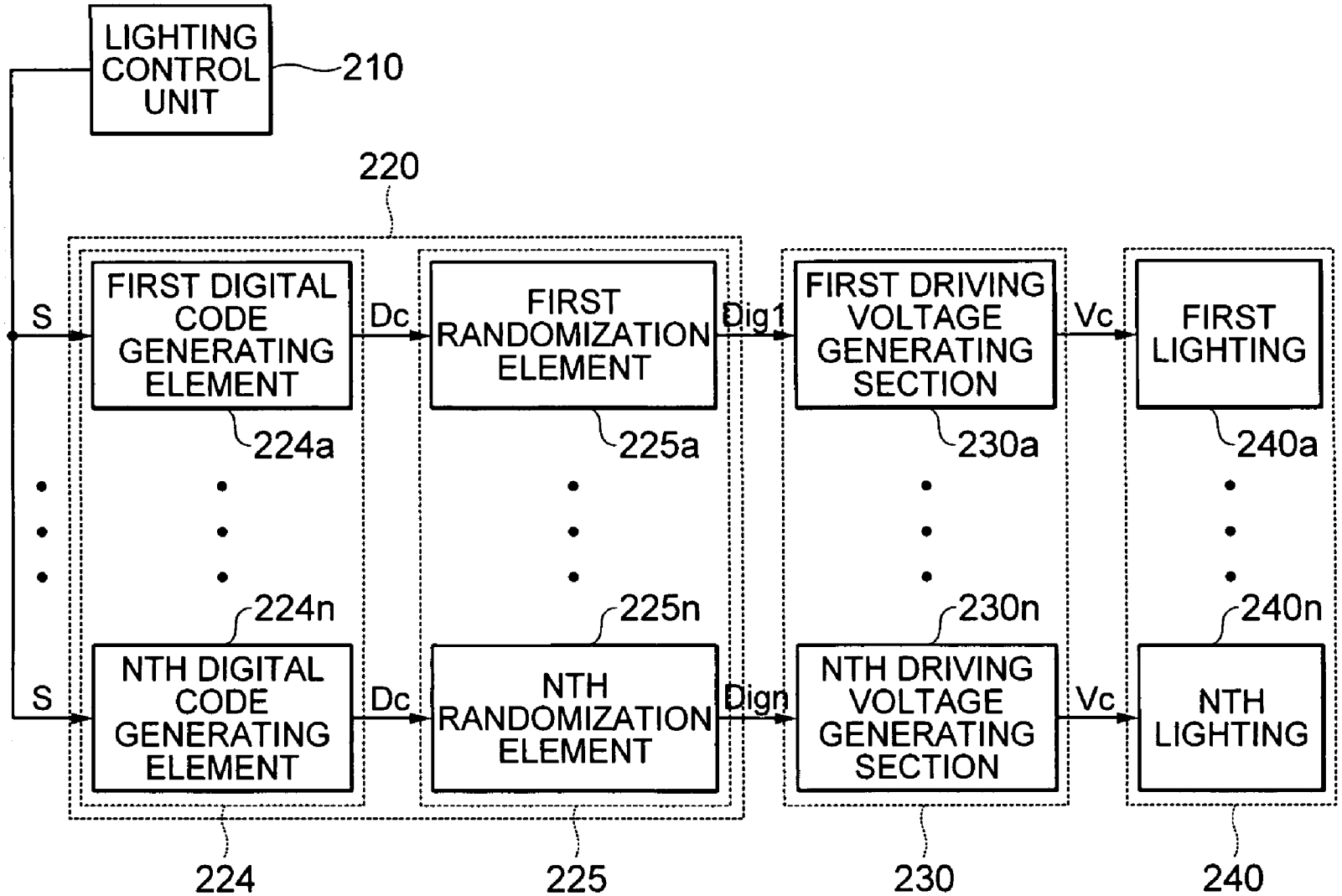

[FIG. 13A]
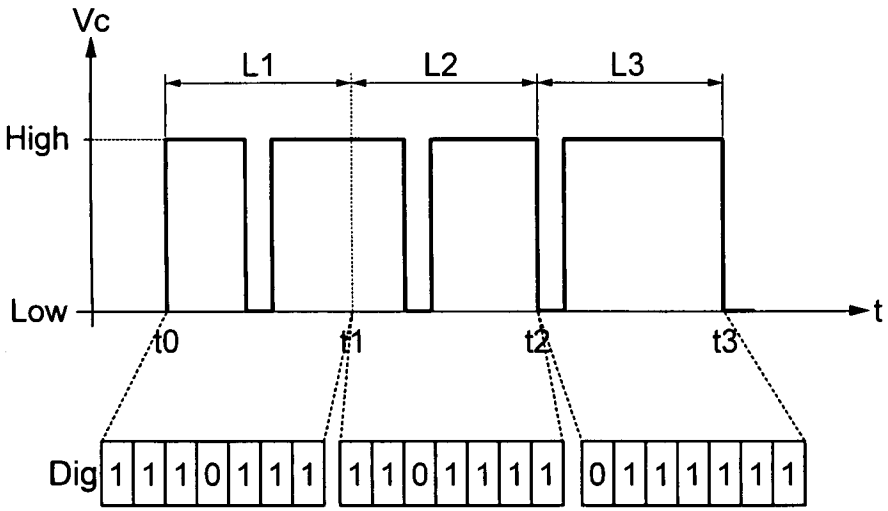
[FIG. 13B]
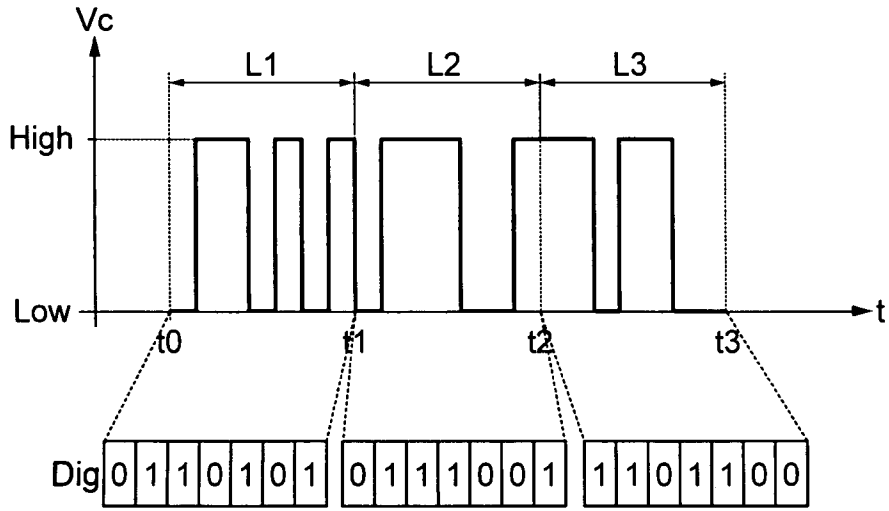

[FIG. 14]
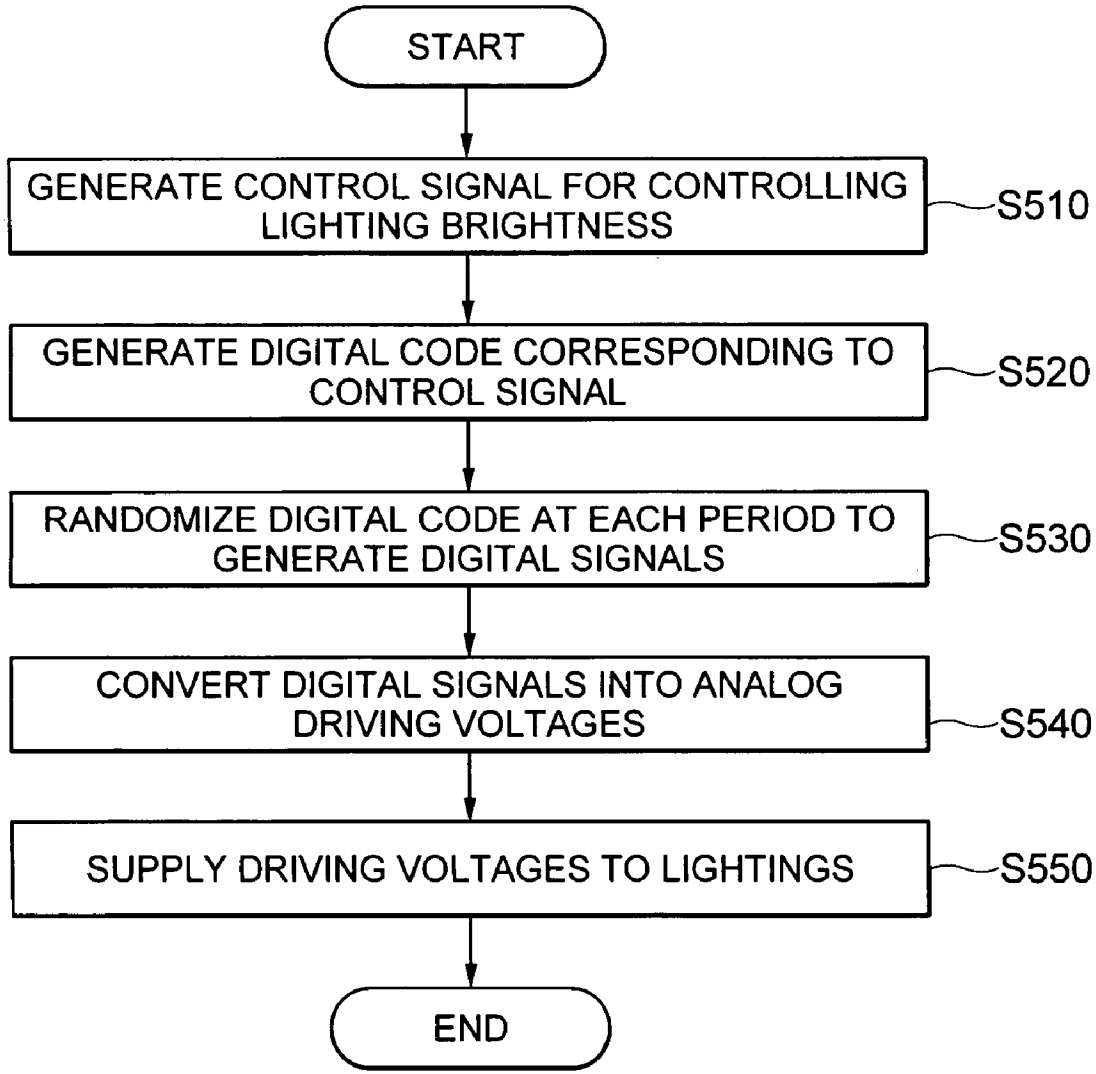

APPARATUS AND METHOD FOR CONTROLLING LIGHTING BRIGHTNESS THROUGH DIGITAL CONVERSION

CROSS-REFERENCE TO RELATED APPLICATIONS

This application claims the benefit of Korean Patent Application Nos. 10-2007-0134204 and 10-2007-0135426 filed with the Korea Intellectual Property Office on Dec. 20, 2007 and Dec. 21, 2007, the disclosure of which is incorporated herein by reference.

BACKGROUND OF THE INVENTION

1. Field of the Invention

The present invention relates to an apparatus and method for controlling lighting brightness through digital conversion.

2. Description of the Related Art

In general, lightings serve to brighten a dark place such that people can recognize something. As for the lightings, light emitting diodes (LEDs), fluorescent lamps, incandescent lamps and so on are usually used.

The brightness and color of lightings can be controlled in accordance with the magnitude of a driving voltage. In this case, the duty width of a PWM (Pulse Width Modulation) signal is adjusted to control the brightness and color.

Hereinafter, a conventional apparatus for controlling lighting brightness will be described with reference to FIGS. 1 and 2.

FIG. 1 is a block diagram of a conventional apparatus for controlling lighting brightness. FIG. 2 is a diagram for explaining a process of controlling the duty width of a PWM signal.

As shown in FIG. 1, the conventional apparatus for controlling lighting brightness includes a lighting control unit 110, a PWM signal generating unit 120, a driving voltage generating unit 130, and a lighting unit 140.

The lighting control unit 110 is connected to the PWM signal generating unit 120 and generates a control signal S for controlling the brightness and color of first to nth lightings 140*a* to 140*n* provided in the lighting unit 140.

The lighting control unit 110 receives a current flowing in each lighting of the lighting unit 140 and compares the current with a preset reference value. When the received current is smaller than the reference value, the lighting control unit 110 generates a control signal S for increasing the magnitude of a driving voltage Vc. When the received current is larger than the reference value, the lighting control unit 110 generates a control signal S for reducing the magnitude of a driving voltage Vc.

The PWM signal generating unit 120 is composed of first to nth PWM signal generating sections 120*a* to 120*n*. The first to nth PWM signal generating sections 120*a* to 120*n* are controlled by the control signal S to generate PWM signals P for increasing or reducing the magnitude of the driving voltage Vc.

At this time, when the control signal S is a signal for reducing the magnitude of the driving voltage Vc, the first to nth PWM signal generating sections 120*a* to 120*n* reduce the width of a duty-on interval of the PWM signals P and then output the PWM signals P. Further, when the control signal S is a signal for increasing the magnitude of the driving voltage Vc, the first nth PWM signal generating sections 120*a* to 120*n* increase the width of the duty-on interval of the PWM signals P and then output the PWM signals P.

Then, the first to nth driving voltage generating sections 130*a* to 130*n* of the driving voltage generating unit 130 receive the PWM signals P of which the duty width is controlled and then output driving voltages Vc corresponding to the PWM signals P, thereby controlling the brightness of the first to nth lightings 140*a* to 140*n*.

However, the apparatus for controlling lighting brightness has the following problems.

The apparatus generates the PWM signals P with a constant period to drive the first to nth lightings 140*a* to 140*n*. At this time, the width of the duty-on interval of the PWM signals P is increased or reduced by the control signal S to control the driving voltages Vc. However, since the PWM signals P have a constant period, a spurious signal is generated.

Further, because of the spurious signal generated when the plurality of lightings 140*a* to 140*n* are driven, noise occurs in the apparatus. Then, lighting efficiency decreases.

SUMMARY OF THE INVENTION

An advantage of the present invention is that it provides an apparatus and method for controlling lighting brightness through digital sampling, in which PWM signals or digital codes are converted at each period to generate non-periodic driving voltages, thereby controlling the brightness of a plurality of lightings.

Additional aspects and advantages of the present general inventive concept will be set forth in part in the description which follows and, in part, will be obvious from the description, or may be learned by practice of the general inventive concept.

According to an aspect of the invention, an apparatus for controlling lighting brightness comprises a light control unit that generates a control signal for controlling the brightness of a plurality of lightings; a digital signal generating unit that converts a signal corresponding to the control signal at each period so as to generate non-periodic digital signals; and a driving voltage generating unit that generate driving voltages by converting the digital signals into analog signals.

The digital signal generating unit may digitally sample a plurality of pulse width modulation (PWM) signals corresponding to the control signal and may shift the sampled PWM signals at each period so as to generate non-periodic digital signals.

The digital signal generating unit may include a PWM signal generating section that is controlled by the control signal so as to generate a plurality of PWM signals; a digital sampling section that digitally samples the plurality of PWM signals; and a shifting section that shifts the digitally-sampled PWM signals at each period so as to generate a plurality of non-periodic digital signals.

The digital sampling section may include a plurality of digital sampling elements which digitally samples the plurality of PWM signals, respectively. The shifting section may include a plurality of shifting elements which convert the digitally-sampled PWM signals into digital signals, respectively.

The respective shifting elements may left-shift or right-shift plural bits of the digitally-sampled PWM signals during one period so as to generate digital signals.

The respective shifting elements may left-shift or right-shift the most significant bit and plural bits adjacent to the most significant bit in the digitally-sampled PWM signals at each period so as to generate digital signals.

The digital signal generating unit may generate a digital code corresponding to the control signal and randomizes the digital code at each period so as to generate digital signals.

The digital signal generating unit may include a digital code generating section that generates a digital code corresponding to the control signal; and a digital conversion section that randomizes the digital code at each period so as to generate digital signals, and the digital code may be a thermometer code.

The driving voltage generating unit may include a plurality of driving voltage generating sections that generate driving voltages for driving the plurality of lightings by converting the digital signals into analog signals.

According to another aspect of the invention, an apparatus for controlling lighting brightness comprises a lighting control unit that generates control signals for controlling the brightness of a plurality of lightings; a PWM signal generating unit that is controlled by the control signal so as to generate a plurality of PWM signals; a digital sampling unit that digitally samples the generated PWM signals; a shifting unit that shifts the digitally-sampled PWM signals at each period so as to generate non-periodic digital signals; and a driving voltage generating unit that generate driving voltages by converting the digital signals into analog signals.

According to a further aspect of the invention, an apparatus for controlling lighting brightness comprises a lighting control unit that generates control signals for controlling the brightness of a plurality of lightings; a digital code generating unit that generates a digital code corresponding to the control signal; a digital conversion unit that randomizes the digital codes at each period so as to generate non-periodic digital signals; and a driving voltage generating unit that generate driving voltages by converting the digital signals into analog signals.

According to a still further aspect of the invention, a method for controlling lighting brightness comprises the steps of: (a) generating a control signal for controlling the brightness of a plurality of lightings; (b) converting a signal corresponding to the control signal at each period so as to generate non-periodic digital signals; (c) generating driving voltages by converting the digital signals into analog signals; and (d) supplying the driving voltages to the plurality of lightings.

In step (b), a plurality of PWM signal corresponding to the control signal may be digitally sampled, and the digitally-sampled PWM signals may be shifted at each period to thereby generate non-periodic digital signals.

In step (b), plural bits may be left-shifted or right-shifted during one period of the digitally-sampled PWM signals. Further, the most significant bit and plural bits adjacent to the most significant bit in the digitally-sampled PWM signals may be left-shifted or right-shifted at each period.

In step (b), digital codes corresponding to the control signal may be generated, and may be then randomized at each period to thereby generate non-periodic digital signals. The digital code may be a thermometer code.

According to a still further aspect of the invention, a method for controlling lighting brightness comprises the steps of: (a) generating a control signal for controlling the brightness of a plurality of lightings; (b) receiving the generated control signal so as to generate a plurality of PWM signals; (c) digitally-sampling the plurality of PWM signals; (d) shifting the digitally-sampled PWM signals at each period, and then generating driving voltages by converting the shifted digitally-sampled PWM signals into analog signals; and (e) supplying the driving voltages to the plurality of lightings.

According to a still further aspect of the invention, a method for controlling lighting brightness comprises the steps of: (a) generating a control signal for controlling the brightness of a plurality of lightings; (b) generating digital codes corresponding to the control signal; (c) randomizing the digital codes at each period so as to generate digital signals; (d) generating driving voltages by converting the digital signals into analog signals; and (e) supplying the generated driving voltages to the plurality of lightings.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a block diagram of a conventional apparatus for controlling lighting brightness;

FIG. 2 is a diagram for explaining a process of controlling the duty width of a PWM signal;

FIG. 3 is a block diagram of an apparatus for controlling lighting brightness according to the invention;

FIG. 4 is a flow chart sequentially showing a method for controlling lighting brightness according to the invention;

FIG. 5 is a block diagram of an apparatus for controlling lighting brightness through digital sampling according to a first embodiment of the invention;

FIG. 6 is a detailed block diagram of the apparatus of FIG. 5;

FIGS. 7A to 7C are diagrams showing a digital sampling process according to the first embodiment of the invention;

FIG. 8 is a diagram for explaining a digital sampling process in a shifting section according to the first embodiment of the invention;

FIG. 9 is a timing chart showing a driving voltage according to the first embodiment of the invention;

FIG. 10 is a flow chart sequentially showing a method for controlling lighting brightness according to the first embodiment of the invention;

FIG. 11 is a block diagram of an apparatus for controlling lighting brightness using digital codes according to a second embodiment of the invention;

FIG. 12 is a detailed block diagram of the apparatus of FIG. 11;

FIGS. 13A and 13B are graphs showing random codes and driving voltages according to the second embodiment of the invention; and FIG. 14 is a flow chart sequentially showing a method for controlling lighting brightness according to the second embodiment.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Hereinafter, an apparatus and method for controlling lighting brightness through digital conversion according to an embodiment of the present invention will be described in detail with reference to the accompanying drawings.

Apparatus for Controlling Lighting Brightness

FIG. 3 is a block diagram of an apparatus for controlling lighting brightness according to the invention. FIG. 4 is a flow chart sequentially showing a method for controlling lighting brightness according to the invention.

As shown in FIG. 3, the apparatus 200 for controlling lighting brightness according to the invention includes a lighting control unit 210 which adjusts lighting brightness of a lighting unit 240, a digital signal generating unit 220 which generates digital signals Dig with a non-periodic property, and a driving generating unit 230 which generates driving voltages Vc by converting the digital signals Dig into analog signals.

The lighting control unit 210 generates a control signal S for adjusting the lighting brightness of the lighting unit 240 to supply to the digital signal generating unit 220 (step S310).

The digital signal generating unit 220 converts a signal corresponding to the control signal S at each period so as to generate digital signals Dig with a non-periodic property (step S320). In this case, the signal corresponding to the control signal S may be a PWM signal or a digital code.

In particular, the digital signal generating unit 220 digitally samples the PWM signal and then left- or right-shifts the digitally-sampled PWM signal at each period so as to generate digital signals Dig with a different value at each period.

Further, the digital signal generating unit 220 may generate digital signals Dig with a non-periodic property by randomizing the digital code at each period.

The driving voltage generating unit 230 receives the digital signals Dig with a non-periodic property and then converts the digital signals Dig into analog signals so as to generate driving voltages Vc (step S330).

In this case, since the generated driving voltages Vc are generated by converting the non-periodic digital signals Dig into analog signals, the driving voltages Vc have a non-periodic property.

The driving voltages Vc generated in such a manner are supplied to the lighting unit 240 so as to adjust the brightness of the lighting unit 240 (step S340).

Hereinafter, first and second embodiments of the invention will be described in detail.

Apparatus for Controlling Lighting Brightness According to First Embodiment

FIG. 5 is a block diagram of an apparatus for controlling lighting brightness through digital sampling according to a first embodiment of the invention. FIG. 6 is a detailed block diagram of the apparatus of FIG. 5. FIGS. 7A to 7C are diagrams showing a digital sampling process according to the first embodiment of the invention.

As shown in FIG. 5, the apparatus 220*a* for controlling lighting brightness through digital sampling according to the first embodiment of the invention includes a lighting control unit 210, a digital signal generating unit 220, a driving voltage generating unit 230, and a lighting unit 240 composed of first to nth lightings 240*a* to 240*n*. The apparatus 220*a* generates non-periodic driving voltages Vc to control the brightness and color of the lighting unit 240. The digital signal generating unit 220 includes a PWM signal generating section 221, a digital sampling section 222, and a shifting section 223.

The lighting control unit 210 is connected to the PWM signal generating section 221 and generates a control signal S for controlling the brightness of the first to nth lightings 240*a* to 240*n* provided in the lighting unit 240. Preferably, the first to nth lightings 240*a* to 240*n* are LEDs.

In this case, the control signal S output from the lighting control unit 210 includes brightness information for controlling the first to nth lightings 250*a* to 250*n*. The brightness information typically indicates information on brightness and color of LED for RGB and can be classified into 256 stages from 0 to 255.

When the first to nth lightings 240*a* to 240*n* are desired to be driven with the brightness and color of the 55th stage, the lighting control unit 210 outputs a control signal S including lighting brightness information corresponding to the 55th stage. When the first to nth lightings 240*a* to 240*n* are desired to be driven with the brightness and color of the 234th stage, the lighting control unit 210 outputs a control signal S including lighting brightness information corresponding to the 234th stage.

As shown in FIG. 6, the digital signal generating unit 220 controls the brightness and color of the lighting unit 240 composed of the first to nth lightings 240*a* to 240*n*.

The PWM signal generating section 221 of the digital signal generating unit 220 is composed of first to nth PWM signal generating elements 221*a* to 221*n* and is connected to the lighting control unit 210 and the digital sampling section 222. The PWM signal generating section 221 receives the control signal S output from the lighting control unit 210 to generate first to nth PWM signals P1 to Pn of which the duty widths are controlled.

At this time, when the first to nth PWM signal generating elements 221*a* to 221*n* output the first to nth PWM signals P1 to Pn, respectively, the first to nth PWM signal generating sections 221*a* to 221*n* are controlled by the same control signal S. Therefore, the first to nth PWM signals P1 to Pn have the same frequency and duty width.

The digital sampling section 222 is composed of first to nth digital sampling elements 222*a* to 222*n* and is connected to the PWM signal generating section 221 and the shifting section 223. The digital sampling section 222 samples the first to nth PWM signals P1 to Pn, generated by the PWM signal generating section 221, into digital signals.

That is, as shown in FIGS. 7A to 7C, the first to nth digital sampling elements 222*a* to 222*n* receive the first to nth PWM signals P1 to Pn, respectively, to sample into digital signals of which each is composed of 0 and 1. At this time, 0 indicates a low level, and 1 indicates a high level.

When the first to nth PWM signals P1 to Pn are digitally sampled, 9 bits belonging to a duty-on interval L1 are sampled into high-level bits, and 8 bits belonging to a duty-off interval L2 are sampled into low-level bits.

As shown in FIG. 7C, when the first to nth PWM signals P1 to Pn are digitally sampled, they can be represented by '1111111110000000'. As described above, the first to nth digital sampling elements 222*a* to 222*n* convert the first to nth analog PWM signals P1 to Pn into the digital signals of '1111111110000000'.

In this embodiment, it has been described that the first to nth PWM signals P1 to Pn are sampled into 17-bit signals. This is just an example for simply explaining the invention. Preferably, the number of bits of a sampled signal can be set by a user.

The shifting section 223 is composed of first to nth shifting elements 223*a* to 223*n* and is connected to the digital sampling section 222 and the driving voltage generating unit 230. The shifting section 223 shifts the PWM signals, sampled by the digital sampling section 222, at each period so as to generate digital signals Dig.

At this time, the respective shifting elements 223*a* to 223*n* generates the digital signals Dig by left-shifting a plurality of bits of the PWM signals, sampled into 17-bit signals by the digital sampling section 222, during one period.

For example, as shown in FIG. 8 which shows the shifting process in the shifting section 223, the shifting section 223 left-shifts the most significant bit (0th bit) and two bits (first and second bits) adjacent to the most significant bit (0th bit) on the basis of one period of the sampled PWM signal, thereby generating the digital signal Dig. As the above-described process is performed at each period, it is possible to generate digital signals which always have a different pattern at each period.

Further, the shifting section 223 may right-shift the sampled signals to generate digital signals Dig. At this time, the shifting section 223 right-shifts the least significant bit (16th bit) and two bits (15th and 14th bits) adjacent to the least significant bit (16th bit) on the basis of one period of the sampled signal, thereby generating the digital signal Dig.

In this embodiment, it has been described that when the most significant bit or the least significant bit and two bits adjacent to the most significant bit or the least significant bit are shifted by the shifting section 223. Without being limited thereto, however, the shifting section 223 may shift a plurality of bits to generate a digital signal Dig.

The driving voltage generating unit 230 is composed of first to nth driving voltage generating sections 230*a* to 230*n* and converts the non-periodic digital signals Dig into analog signals so as to generate a plurality of driving voltages Vc.

As shown in FIG. 9 which shows the driving voltage Vc, the first driving voltage generating section 230*a* generates an analog driving voltage Vc by converting bits of 0 in the digital signal Dig, generated by the shifting section 223, into a low level and converting bits of 1 in the digital signal Dig into a high level.

In particular, the second to nth driving voltage generating sections 230*b* to 230*n* have the same configuration as that of the first driving voltage generating section 230*a* and perform the same operation to output driving voltages Vc with the same magnitude and a non-periodic property.

In the apparatus for controlling lighting brightness through digital sampling according to the invention, non-periodic driving voltages Vc of which the forms are different from each other are generated at each period (L0) and are then supplied to the first to nth lightings 250*a* to 250*n*. Therefore, it is possible to prevent spurious signals.

Further, since the apparatus can prevent spurious signals, it is possible to enhance the efficiency of the first to nth lightings 240*a* to 240*n*.

Method for Controlling Lighting Brightness According to First Embodiment

Hereinafter, referring to FIGS. 5 to 10, a method for controlling lighting brightness through digital sampling according to the first embodiment of the invention will be described in detail.

FIG. 10 is a flow chart sequentially showing a method for controlling lighting brightness through digital sampling using the apparatus 200*a* according to the first embodiment of the invention.

As shown in FIG. 10, a control signal S for controlling the brightness and color of the first to nth lightings 240*a* to 240*n* is generated (step S410). Preferably, the first to nth lightings 240*a* to 240*n* are LEDs.

In this case, the control signal S output from the lighting control unit 210 includes lighting brightness information for controlling the first to nth lightings 240*a* to 240*n*. The lighting brightness information typically indicates information on brightness and color of LED for RGB and can be classified into 256 stages from 0 to 255.

When the first to nth lightings 240*a* to 240*n* are desired to be driven with the brightness and color of the 55th stage, a control signal S including lighting brightness information corresponding to the 55th stage is generated. When the first to nth lightings 240*a* to 240*n* are desired to be driven with the brightness and color of the 234th stage, a control signal S including lighting brightness information corresponding to the 234th stage is generated.

Then, the PWM signal generating section 221 is controlled by the generated control signal S. The PWM signal generating section 221 generates first to nth PWM signals P1 to Pn of which the duty widths are controlled by the control signal S (step S420).

The digital sampling section 222 receives the first to nth PWM signals P1 to Pn to sample into digital signals (step S430). At this time, the digital sampling section 222 samples the first to nth PWM signals P1 to Pn by converting high-level bits into 1 and converting low-level bits into 0.

After the digital sampling of the first to nth PWM signals P1 to Pn is completed, the digitally-sampled PWM signals are shifted at each period and are then converted into analog signals to generate driving voltages Vc with a non-periodic property (step S440).

In the shifting process of step S440, it is preferable that a plurality of bits are left-shifted during one period of the digitally-sampled signal. In this case, the most significant bit and a plurality of bits adjacent to the most significant bit in the digitally-sampled signal are left-shifted at each period.

Alternatively, in step S440, a plurality of bits may be right-shifted during one period of the digitally-sampled signal. In this case, the least significant bit and a plurality of bits adjacent to the least significant bit in the digitally-sampled signal are right-shifted at each period.

The signals left- or right-shifted at each period are converted into analog signals so as to be supplied to the first to nth lightings 250*a* to 250*n*. Then, the brightness and color of the first to nth lightings 250*a* to 250*n* can be controlled.

Through such a process, the left- or right-shifted signals are converted into analog signals so as to be supplied to the first to nth lightings 240*a* to 240*n*. Then, it is possible to control the brightness and color of the first to nth lightings 240*a* to 240*n*.

In the above-described method for controlling lighting brightness through digital sampling, a plurality of non-periodic driving voltages Vc of which the forms are different are generated at each period (L0) so as to be supplied to the first to nth lightings 240*a* to 240*n*, respectively. Therefore, it is possible to prevent spurious signals.

Further, since spurious signals can be prevented, it is possible to enhance the efficiency of the first to nth lightings 240*a* to 240*n*.

Apparatus for Controlling Lighting Brightness According to Second Embodiment

Referring to FIGS. 11 to 13, an apparatus for controlling lighting brightness using digital codes according to a second embodiment of the invention will be described. However, the duplicated descriptions of the same components as those of the first embodiment will be omitted.

FIG. 11 is a block diagram of an apparatus for controlling lighting brightness using digital codes according to a second embodiment of the invention. FIG. 12 is a detailed block diagram of the apparatus of FIG. 11. FIGS. 13A and 13B are graphs showing random codes and driving voltages according to the second embodiment of the invention.

As shown in FIG. 11, the apparatus 200*b* for controlling lighting brightness using digital codes according to the second embodiment of the invention includes a lighting control unit 210, a digital signal generating unit 220, a driving voltage generating unit 230, and a lighting unit 240 composed of first to nth lightings 240*a* to 240*n*. The apparatus 200*b* generates non-periodic driving voltages Vc to adjust the brightness and color of the lighting unit 240.

The lighting control unit 210 is connected to the digital signal generating unit 220 and generates a control signal S for controlling the brightness and color of the first to nth lightings 240*a* to 240*n* provided in the lighting unit 240. Preferably, the first to nth lightings 240*a* to 240*n* are LEDs.

As shown in FIG. 12, the digital signal generating unit 220 includes a digital code generating section 224 and a digital conversion section 225, and generates digital signals Dig with a non-periodic property.

The digital code generating section 224, which is composed of first to nth digital code generating elements 224*a* to 224*n*, is connected to the lighting control unit 210 and the digital conversion section 225, and generates a digital code Dc corresponding to the control signal S.

The control signal S includes lighting brightness information for controlling the brightness and color of the first to nth lightings 240*a* to 240*n*. As shown in Table 1, when it is assumed that the control signal S can be represented by eight stages from 0th to seventh stages, each stage indicates the brightness and color information of the plurality of lightings 240*a* to 240*n*.

TABLE 1

| Control signal S | Binary | Thermometer code |
|---|---|---|
| 7 | 111 | 1111111 |
| 6 | 110 | 0101111 |
| 5 | 101 | 0011111 |
| 4 | 100 | 0001111 |
| 3 | 011 | 0000111 |
| 2 | 010 | 0000011 |
| 1 | 001 | 0000001 |
| 0 | 000 | 0000000 |

When the control signal S is represented by 0, the control signal S is a signal for representing the darkest lighting. When the control signal S is represented by 7, the control signal S is a signal for representing the brightest lighting. In the second embodiment, the control signal S is limited to the range of the 0th to seventh steps. However, this is an example for explaining the second embodiment. In the apparatus 200*b* according to the second embodiment of the invention, the brightness step of the control signal S can be set in the range of 0 to 255.

The first to nth digital code generating sections 224*a* to 224*n* having received the control signal S digitally convert the control signal S into a code corresponding to the control signal S. For example, when the control signal S includes brightness information corresponding to the fourth step, the first digital code generating element 224*a* generates a digital code Dc of '0001111'. When the control signal S includes brightness information corresponding to the seventh step, the first digital code generating element 224*a* generates a digital code Dc of '1111111'.

In particular, the digital code generating section 224 can use a thermometer code as the digital code Dc.

In such a manner, the first to nth digital code generating elements 224*a* to 224*n* generate digital codes Dc corresponding to the applied control signal S and then deliver the digital codes Dc to the digital conversion section 225.

The digital conversion section 225, which is composed of first to nth randomization elements 225*a* to 225*n*, is connected to the digital code generating section 224 and the driving voltage generating unit 230 and randomizes the generated digital codes Dc.

The first randomization element 225*a* is connected to the first digital code generating element 224*a* so as to receive the digital code Dc from the first digital code generating element 224*a*. When the digital code Dc is received, the first randomization element 224*a* randomizes the digital code Dc so as to generate a digital signal Dig.

The digital signal Dig generated by the first randomization element 225*a* can be represented as shown in Table 2.

TABLE 2

| Control signal | Randomized thermometer code | | | | | | | Number of high level |
|---|---|---|---|---|---|---|---|---|
| 7 | 1 | 1 | 1 | 1 | 1 | 1 | 1 | 7 |
| 6 | 1 | 1 | 1 | 0 | 1 | 1 | 1 | 6 |
| 5 | 1 | 0 | 1 | 0 | 1 | 1 | 1 | 5 |
| 4 | 0 | 1 | 1 | 0 | 1 | 0 | 1 | 4 |
| 3 | 0 | 0 | 1 | 0 | 0 | 1 | 1 | 3 |
| 2 | 0 | 0 | 0 | 1 | 0 | 0 | 1 | 2 |
| 1 | 0 | 0 | 0 | 0 | 0 | 0 | 1 | 1 |
| 0 | 0 | 0 | 0 | 0 | 0 | 0 | 0 | 0 |

As shown in Table 2, when the control signal S is represented by 6, the first digital code generating element 224*a* generates a digital code Dc of '0111111'. The first randomization element 225*a* receiving the digital code Dc of '0111111' randomizes the digital code Dc so as to generate a digital signal Dig1 of '1110111'.

Further, when the control signal S is represented by 3, the first digital code generating element 224*a* generates a digital code Dc of '0000111'. The first randomization element 225*a* receiving the digital code Dc of '0000111' randomizes the digital code Dc so as to generate a digital signal Dig1 of '0010011'.

Although the randomizing process has been described for only the first randomization element 225*a*, the second to nth randomization elements 225*b* to 225*n* performs the same operation as that of the first randomization element 225*a*, because they receive the same digital code Dc.

The driving voltage generating unit 230, which is composed of first to nth driving voltage generating sections 230*a* to 230*n*, is connected to the digital conversion section 225 and the lighting unit 240. The driving voltage generating unit 230 converts the digital signals Dig, applied through the digital conversion section 225, into analog signals so as to generate driving voltages Vc with a non-periodic property.

For example, when the control signal S output from the lighting control unit 210 has brightness information corresponding to the sixth step, a digital code Dc of '0111111' is generated, and a digital code Dig of '1110111' is generated.

Accordingly, as shown in FIG. 13A, the driving voltage generating unit 230 generates a driving voltage Vc of '1110111' at an interval L1. Further, the driving voltage generating unit 230 generates a driving voltage Vc of '1101111', which is obtained by randomizing the digital code Dc of '0111111', at an interval L2.

Further, when the control signal output from the lighting control unit 210 has brightness information corresponding to the fourth step, a digital code Dc of '0001111' and a digital signal Dig of '0110101' are generated.

Accordingly, as shown in FIG. 13B, the driving voltage generating unit 230 generates a driving voltage Vc of '0110101' at an interval L1. Further, the driving voltage generating unit 230 generates a driving voltage Vc of '0111001', which is obtained by randomizing the digital code Dc of '0001111', at an interval L2.

In particular, although the digital code Dc is randomized at each interval, the number of high-level bits is maintained the same at each interval. Therefore, it is possible to constantly maintain the brightness and color of the lighting unit 240 at all times.

Therefore, the driving voltage generating unit 230 generates non-periodic driving voltages Vc at each period and then supplies the driving voltages Vc to the plurality of lightings 240*a* to 240*n*, thereby controlling the brightness and color of the lightings.

As described above, the apparatus 200*b* for controlling lighting brightness using digital codes according to the second embodiment of the invention supplies non-periodic driving voltages Vc with a different pattern at each period so as to control the brightness and color of the plurality of lightings 240*a* to 240*n*. Therefore, it is possible to reduce spurious signals.

Further, as the spurious signals are reduced, it is possible to enhance the efficiency of the plurality of lightings 240*a* to 240*n*.

Method for Controlling Lighting Brightness According to Second Embodiment

Referring to FIGS. 11 to 14, a method for controlling lighting brightness using the apparatus 220*b* according to the second embodiment will be described.

FIG. 14 is a flow chart sequentially showing a method for controlling lighting brightness according to the second embodiment.

First, as shown in FIG. 14, a control signal S for controlling the brightness and color of the plurality of lightings 240*a* to 240*n* is generated (step S510). Preferably, the plurality of lightings 240*a* to 240*n* are LEDs.

After the control signal S is generated, a digital code Dc corresponding to the control signal S is generated (step S520).

The digital code Dc generated in step S520 is preset by a user and is classified depending on the control signal S. In particular, a thermometer code may be used as the digital code Dc.

After the digital code Dc is generated, the generated digital code Dc is randomized to generate digital signals Dig (step S530). In step S530, it is preferable that the digital code Dc is randomized at each period so as to generate digital signals Dig with a non-periodic property.

The digital signals Dig generated in step S530 are converted into analog signals so as to generate driving voltages Vc (step S540).

Then, the analog driving voltages Vc are supplied to the plurality of lightings 240*a* to 240*n*, thereby controlling the brightness and color of the lightings 240*a* to 240*n*.

In the method for controlling lighting brightness according to the second embodiment, the non-periodic driving voltages Vc with a different pattern are supplied to the plurality of lightings 240*a* to 240*n* at each period so as to control the brightness and color of the lightings 240*a* to 240*n*. Therefore, it is possible to reduce spurious signals.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An apparatus for controlling lighting brightness, comprising:

a light control unit that generates a control signal for controlling the brightness of a plurality of lightings;

a digital signal generating unit that converts a signal corresponding to the control signal at each period so as to generate non-periodic digital signals; and a driving voltage generating unit that generates driving voltages by converting the digital signals into analog signals.

2. The apparatus according to claim 1, wherein the digital signal generating unit digitally samples a plurality of pulse width modulation (PWM) signals corresponding to the control signal and shifts the sampled PWM signals at each period so as to generate the non-periodic digital signals.

3. The apparatus according to claim 2, wherein the digital signal generating unit includes:

a PWM signal generating section that is controlled by the control signal so as to generate a plurality of PWM signals;

a digital sampling section that digitally samples the plurality of PWM signals; and a shifting section that shifts the digitally-sampled PWM signals at each period so as to generate a plurality of non-periodic digital signals.

4. The apparatus according to claim 3, wherein the digital sampling section includes a plurality of digital sampling elements which digitally samples the plurality of PWM signals, respectively.

5. The apparatus according to claim 3, wherein the shifting section includes a plurality of shifting elements which convert the digitally-sampled PWM signals into digital signals, respectively.

6. The apparatus according to claim 5, wherein the respective shifting elements left-shift plural bits of the digitally-sampled PWM signals during one period so as to generate the non-periodic digital signals.

7. The apparatus according to claim 5, wherein the respective shifting elements left-shift the most significant bit and plural bits adjacent to the most significant bit in the digitally-sampled PWM signals at each period so as to generate the non-periodic digital signals.

8. The apparatus according to claim 5, wherein the respective shifting elements right-shifts plural bits of the digitally-sampled PWM signals during one period so as to generate the non-periodic digital signals.

9. The apparatus according to claim 5, wherein the respective shifting elements right-shift the least significant bit and plural bits adjacent to the least significant bit in the digitally-sampled PWM signals at each period so as to generate the non-periodic digital signals.

10. The apparatus according to claim 1, wherein the digital signal generating unit generates a digital code corresponding to the control signal and randomizes the digital code at each period so as to generate the non-periodic digital signals.

11. The apparatus according to claim 10, wherein the digital signal generating unit includes a digital code generating section that generates a digital code corresponding to the control signal; and a digital conversion section that randomizes the digital code at each period so as to generate the non-periodic digital signals.

12. The apparatus according to claim 11, wherein the digital code is a thermometer code.

13. The apparatus according to claim 1, wherein the driving voltage generating unit includes a plurality of driving voltage generating sections that generate driving voltages for driving the plurality of lightings by converting the digital signals into analog signals.

14. An apparatus for controlling lighting brightness, comprising:

a lighting control unit that generates control signals for controlling the brightness of a plurality of lightings;

a PWM signal generating unit that is controlled by the control signal so as to generate a plurality of PWM signals;

a digital sampling unit that digitally samples the generated PWM signals;

a shifting unit that shifts the digitally-sampled PWM signals at each period so as to generate non-periodic digital signals; and a driving voltage generating unit that generate driving voltages by converting the digital signals into analog signals.

15. An apparatus for controlling lighting brightness, comprising:

a lighting control unit that generates control signals for controlling the brightness of a plurality of lightings;

a digital code generating unit that generates a digital code corresponding to the control signal;

a digital conversion unit that randomizes the digital codes at each period so as to generate non-periodic digital signals; and a driving voltage generating unit that generate driving voltages by converting the digital signals into analog signals.

16. A method for controlling lighting brightness, comprising the steps of:

(a) generating a control signal for controlling the brightness of a plurality of lightings;

(b) converting a signal corresponding to the control signal at each period so as to generate non-periodic digital signals;

(c) generating driving voltages by converting the digital signals into analog signals; and (d) supplying the driving voltages to the plurality of lightings.

17. The method according to claim 16, wherein in step (b), a plurality of PWM signal corresponding to the control signal are digitally sampled, and the digitally-sampled PWM signals are shifted at each period to thereby generate the non-periodic digital signals.

18. The method according to claim 17, wherein in step (b), plural bits are left-shifted or right-shifted during one period of the digitally-sampled PWM signals.

19. The method according to claim 17, wherein in step (b), the most significant bit and plural bits adjacent to the most significant bit in the digitally-sampled PWM signals are left-shifted or right-shifted at each period.

20. The method according to claim 16, wherein in step (b), digital codes corresponding to the control signal are generated, and are then randomized at each period to thereby generate the non-periodic digital signals.

21. The method according to claim 20, wherein the digital code is a thermometer code.

22. A method for controlling lighting brightness, comprising the steps of:

(a) generating a control signal for controlling the brightness of a plurality of lightings;

(b) receiving the generated control signal so as to generate a plurality of PWM signals;

(c) digitally-sampling the plurality of PWM signals;

(d) shifting the digitally-sampled PWM signals at each period, and then generating driving voltages by converting the shifted digitally-sampled PWM signals into analog signals; and (e) supplying the driving voltages to the plurality of lightings.

23. A method for controlling lighting brightness, comprising the steps of:

(a) generating a control signal for controlling the brightness of a plurality of lightings;

(b) generating digital codes corresponding to the control signal;

(c) randomizing the digital codes at each period so as to generate digital signals;

(d) generating driving voltages by converting the digital signals into analog signals; and (e) supplying the generated driving voltages to the plurality of lightings.

* * * * *